US007185395B2

(12) United States Patent
Pullins

(10) Patent No.: US 7,185,395 B2
(45) Date of Patent: Mar. 6, 2007

(54) BAGLESS VACUUM CLEANER

(75) Inventor: Alan T. Pullins, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 630 days.

(21) Appl. No.: 10/686,919

(22) Filed: Oct. 16, 2003

(65) Prior Publication Data

US 2004/0074043 A1 Apr. 22, 2004

Related U.S. Application Data

(60) Provisional application No. 60/419,553, filed on Oct. 18, 2002.

(51) Int. Cl.
*A47L 9/10* (2006.01)
*A47L 9/12* (2006.01)

(52) U.S. Cl. ..... 15/353; 15/351

(58) Field of Classification Search ..... 15/327.1, 15/327.2, 327.3, 327.4, 327.5, 327.6, 327.7, 15/347, 350–353; 55/320, 323, 462, 465, 55/486, 487, DIG. 3
See application file for complete search history.

(56) References Cited

U.S. PATENT DOCUMENTS

| | | | | |
|---|---|---|---|---|
| 95,794 A | | 10/1869 | Graves | |
| 133,436 A | | 11/1872 | Grassler | |
| 352,063 A | | 11/1886 | Optenberg | |
| 1,133,543 A | | 3/1915 | Duffle | |
| 1,230,784 A | | 6/1917 | Rice | |
| 1,230,827 A | * | 6/1917 | Duffie | 15/351 |
| 1,762,142 A | * | 6/1930 | Breton | 15/320 |
| 1,847,233 A | * | 3/1932 | Bilde | 96/227 |
| 2,346,339 A | * | 4/1944 | Vose | 15/344 |
| 3,959,844 A | * | 6/1976 | Cyphert | 15/320 |
| 5,080,697 A | | 1/1992 | Finke | |
| 5,254,147 A | | 10/1993 | Finke | |
| 5,961,677 A | | 10/1999 | Scott | |
| 6,243,912 B1 | * | 6/2001 | Grey | 15/320 |
| 6,546,592 B1 | * | 4/2003 | Cockburn et al. | 15/344 |

FOREIGN PATENT DOCUMENTS

| | | | |
|---|---|---|---|
| JP | 52-20669 | * | 2/1977 |
| JP | 56-136642 | | 10/1981 |
| JP | 56-136650 | | 10/1981 |

* cited by examiner

*Primary Examiner*—Terrence R. Till
(74) *Attorney, Agent, or Firm*—King & Schickli, PLLC

(57) ABSTRACT

A vacuum cleaner is provided including a housing, a nozzle inlet, a suction generator carried on the housing and a dirt vessel carried on the housing. The dirt vessel includes a sidewall, a bottom wall and an air inlet and an air outlet. A filter shield is aligned with the air inlet to deflect an airstream entering the dirt vessel through the air inlet. A filter element is also provided to clean fine dirt and debris from the airstream.

14 Claims, 2 Drawing Sheets

BAGLESS VACUUM CLEANER

This application claims the benefit of U.S. Provisional Patent Application Ser. No. 60/419,553 filed on Oct. 18, 2002.

TECHNICAL FIELD

The present invention relates generally to the floor care equipment field and, more particularly, to a bagless vacuum cleaner incorporating a unique dirt vessel assembly as well as to that dirt vessel assembly.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner includes a housing, a nozzle inlet, a suction generator carried on the housing and a dirt vessel carried on the housing. The dirt vessel includes a sidewall, a bottom wall, an air inlet and an air outlet. A filter shield is aligned with the air inlet to deflect an airstream entering the dirt vessel. Additionally, the vacuum cleaner includes a filter element.

More specifically describing the invention, the air inlet is provided in the bottom wall of the dirt vessel. An air inlet conduit is provided between the air inlet and the filter shield. Additionally, a gap is provided between an open end of the air inlet conduit and the filter shield.

In one possible embodiment of the present invention, the filter shield is carried by the filter element. Additionally, the filter element may include a filter media sandwiched between two screens. In an alternative form, the filter element may include a frame supporting a pleated filter media of a type well known in the art to be useful for filtering dirt and debris from an airstream in a vacuum cleaner.

The air outlet may be formed by an open top of the filter vessel. The filter element covers the air outlet. A dirt collection chamber is defined by the walls of the dirt vessel. In one possible embodiment the dirt collection chamber is substantially cylindrical in shape. In this embodiment the air inlet conduit is received concentrically within the sidewall of the dirt vessel. Thus, at least a portion of the dirt collection chamber is annular in shape.

Still further describing the invention, an exhaust manifold is provided. The exhaust manifold includes a manifold inlet in fluid communication with the air outlet of the dirt vessel and a discharge outlet in communication with the suction generator. A filter element may be carried by the exhaust manifold and the exhaust manifold may be carried by the housing. In an alternative embodiment the filter element is carried by the dirt vessel. In still another alternative embodiment both the filter element and exhaust manifold are carried by the dirt vessel. In that embodiment the exhaust manifold also includes a carrying handle.

In accordance with yet another aspect of the present invention a dirt vessel assembly is provided. The dirt vessel assembly includes a sidewall, a bottom wall, an air inlet and an air outlet. Additionally, the assembly includes an exhaust manifold having a manifold inlet in fluid communication with the air outlet and a discharge outlet. A filter element is positioned between the air outlet and the manifold inlet. Further, a filter shield is aligned with the air inlet to deflect an airstream entering the dirt vessel away from the filter element.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
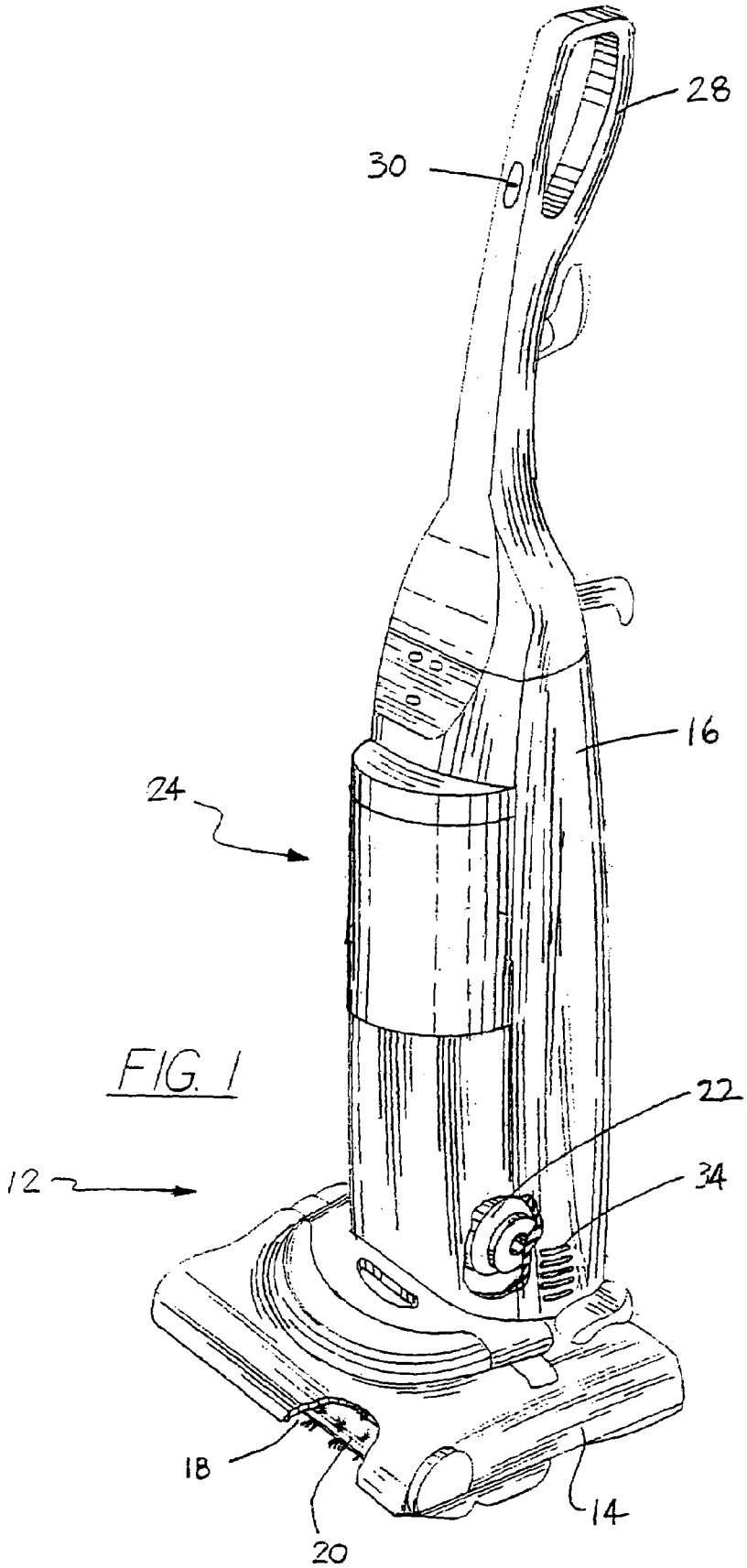
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent also covers canister and hand-held vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner to and fro across the floor. Wheels (not shown) carried on the housing 12 allow the vacuum cleaner 10 to be moved smoothly across the floor. As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly) and a dirt vessel 24 having a dirt collection chamber 26. The suction generator 22 is provided at the bottom of the canister section 16 below the dirt vessel 24. This serves to provide the vacuum cleaner 10 with a lower center of gravity for stability against inadvertently tipping over. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. The dirt and debris are then drawn by the suction generator 22 through the nozzle inlet 18 into the dirt vessel 24 and through the filter element 32. Dirt and debris are collected in the dirt collection chamber 26. The airstream is then directed over the motor of the suction generator 22 to provide cooling before being routed through a final filter, to remove any carbon particles stripped from the brushes of the motor by the airstream, before exhausting the airstream through an exhaust port 34 into the environment.

The dirt vessel 24 includes a sidewall 36 and a bottom wall 38 that define the dirt collection chamber 26. The dirt vessel 24 also includes an open top 40 that functions as an air outlet and an air inlet 42 in the bottom wall 38. An air inlet conduit 44 projects upwardly through the central portion of the dirt collection chamber 26 from the air inlet 42. Where the dirt collection chamber 26 is substantially cylindrical in shape as illustrated, the air inlet conduit 44 is concentrically received in that chamber. Accordingly, at least a portion of the dirt collection chamber 26 is annular in shape.

Figure 2:
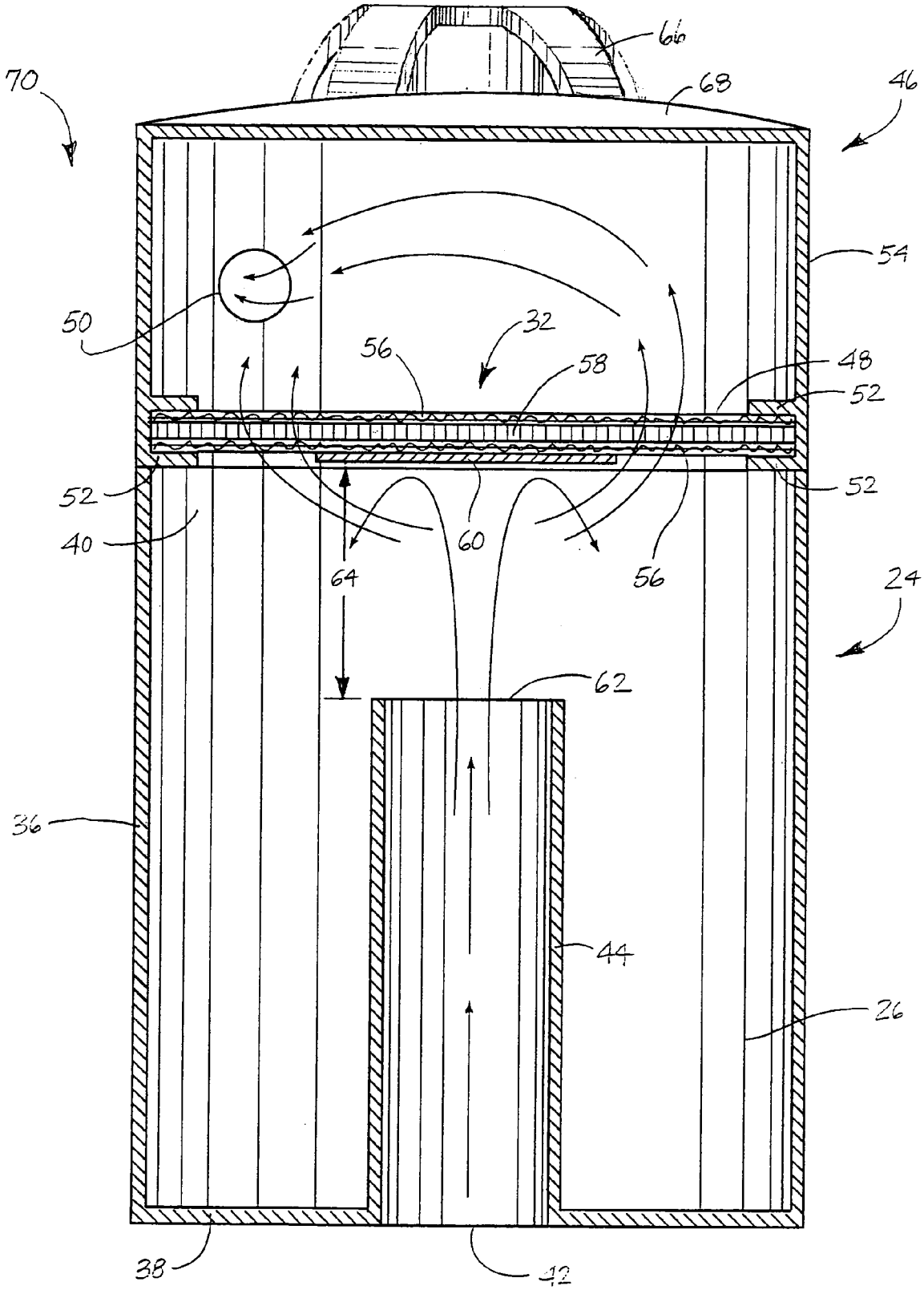
FIG. 2 is a detailed, partially cross-sectional and schematic view illustrating the dirt vessel assembly of the present invention.

As further illustrated in FIG. 2, the vacuum cleaner 10 includes an exhaust manifold 46. The exhaust manifold 46 includes a manifold inlet 48 in fluid communication with the open top or air outlet 40 of the dirt vessel 24 and a discharge outlet 50 in fluid communication with the suction generator 22.

The filter element 32 is positioned between the dirt vessel 24 and the exhaust manifold 46. In the illustrated embodiment the filter element 32 is captured between a series of tabs 52 provided on the housing 54 of the exhaust manifold 46. The filter element 32 may include two screens 56 holding and sandwiching a pleated filter material 58 known in the art to be useful for filtering dirt and debris from an airstream in a vacuum cleaner. Alternatively, the filter element 32 could include a frame holding a pleated filter material.

A filter shield 60 is also provided. The filter shield 60 is aligned with the air inlet 42 and is spaced from the open end 62 of the air inlet conduit 44. In the illustrated embodiment the filter shield 60 is carried by the filter element 32. It should be appreciated, however, that it could be mounted to and carried by the housing 54 of the exhaust manifold 46 or the sidewall 36 of the dirt vessel 24 if desired.

In operation, the rotary agitator 20 beats dirt and debris from the nap of an underlying carpet being cleaned. The suction generator 22 draws that dirt and debris in an airstream through the nozzle inlet 18 into the vacuum cleaner 10. That airstream is conveyed by means of hoses and/or conduits from the nozzle inlet to the air inlet 42 in the bottom wall 38 of the dirt vessel 24. As a consequence the airstream follows the shortest and straightest route from the nozzle inlet 18 to the dirt cup 24. Accordingly, air entrained with dirt and debris is directed and moved with the highest possible efficiency. This ensures optimal cleaning action for any power of suction generator.

The airstream then travels through the air inlet conduit 44 which directs the airstream into the filter shield 60. The airstream then flows through the gap 64 provided between the open end 62 of the air inlet conduit 44 and the filter element 32 or filter shield 60. Thus, the airstream flows into the dirt collection chamber 26 of the dirt vessel 24 in a pattern similar in shape to an umbrella. Next the airstream is drawn through the filter element 32 which freely allows the passage of air but prevents the passage of both coarse and fine dirt and debris which become entrapped in and collect at the bottom of the dirt collection chamber 26.

The relatively clean air is then drawn from the exhaust manifold 46 through the discharge outlet 50 to the suction generator 22. There the airstream flows over the motor of the suction generator 22 to provide cooling. The air is then subjected to a final filtration in order to remove any carbon particles that may have been picked up from the brushes of the suction generator motor before being exhausted into the environment through the exhaust port 34.

At certain times during operation, it may become necessary for the operator to empty dirt and debris from the dirt collection chamber 26. In order to do this, the operator grasps a handle 66 attached to the top wall 68 of the exhaust manifold 46 in order to remove the dirt vessel assembly 70 from the canister section 16. Next, the exhaust manifold 46 is twisted relative to the dirt vessel 24. The exhaust manifold 46 including the filter element 32 are then removed to expose the open top 40 of the dirt vessel 24. The dirt vessel 24 is then inverted to dump dirt and debris from the dirt collection chamber 26 into an underlying garbage can or trash bag. If necessary, the filter element 32 may also be removed from the exhaust manifold 46 and cleaned or replaced. The exhaust manifold 46 and dirt vessel 24 are then reconnected and the entire assembly 70 is then repositioned back in the canister section 16 so that the vacuum cleaner 10 is again ready for operation.

The foregoing description of the preferred embodiments of this invention have been presented for purposes of illustration and description. It is not intended to be exhaustive or to limit the invention to the precise form disclosed. Obvious modifications or variations are possible in light of the above teachings.

For example, while the illustrated embodiment is an upright vacuum cleaner, the present invention also relates to and includes canister and hand-held vacuum cleaners. Further, while the illustrated embodiment is a "clean air" system with the suction generator 22 downstream from the dirt cup 24 and dirt collection chamber 26, the present invention also includes "dirty air" systems where the suction generator is located upstream of either or both of these structures.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A vacuum cleaner, comprising:

a housing;

a nozzle inlet;

a suction generator carried on said housing; and a dirt vessel carried on said housing, said dirt vessel including a sidewall, a bottom wall, an air inlet and an air outlet;

an exhaust manifold connected to said dirt vessel, said exhaust manifold including a carrying handle;

a filter shield aligned with said air inlet to deflect an airstream entering said dirt vessel through said air inlet; and a filter element wherein said exhaust manifold and said filter element are carried on said dirt vessel.

2. The vacuum cleaner of claim 1, wherein said air inlet is in said bottom wall of said dirt vessel.

3. The vacuum cleaner of claim 2, wherein an air inlet conduit is provided between said air inlet and said filter shield.

4. The vacuum cleaner of claim 3, wherein a gap is provided between an open end of said air inlet conduit and said filter shield.

5. The vacuum cleaner of claim 4, wherein said filter shield is carried by said filter element.

6. The vacuum cleaner of claim 5, wherein said filter element includes two screens sandwiching a filter material.

7. The vacuum cleaner of claim 5, wherein said air outlet is formed by an open top of said filter vessel.

8. The vacuum cleaner of claim 7, wherein said filter element covers said air outlet.

9. The vacuum cleaner of claim 8, wherein said dirt vessel includes a dirt collection chamber.

10. The vacuum cleaner of claim 9, wherein said dirt collection chamber is substantially cylindrical in shape.

11. The vacuum cleaner of claim 10, wherein said air inlet conduit is received concentrically within said sidewall of said dirt vessel.

12. The vacuum cleaner of claim 11, wherein at least a portion of said dirt collection chamber is annular in shape.

13. The vacuum cleaner of claim 1, wherein said exhaust manifold includes a manifold inlet in fluid communication with said air outlet of said dirt vessel and a discharge outlet in communication with said suction generator.

14. The vacuum cleaner of claim 1, wherein said housing includes a nozzle section including said nozzle inlet and a canister section wherein said nozzle section and said canister section are pivotally connected together.

* * * * *